US006546580B2

(12) United States Patent
Shimada

(10) Patent No.: US 6,546,580 B2
(45) Date of Patent: Apr. 15, 2003

(54) AIR MATTRESS

(75) Inventor: Takeshi Shimada, Hiroshima (JP)

(73) Assignee: Molten Corporation, Hiroshima (JP)

( * ) Notice: Subject to any disclaimer, the term of this patent is extended or adjusted under 35 U.S.C. 154(b) by 0 days.

(21) Appl. No.: 09/983,196

(22) Filed: Oct. 23, 2001

(65) Prior Publication Data

US 2002/0050010 A1 May 2, 2002

(30) Foreign Application Priority Data

Oct. 31, 2000 (JP) ..... 2000-332575

(51) Int. Cl.[7] ..... A47C 27/10
(52) U.S. Cl. ..... 5/710; 5/713; 5/706
(58) Field of Search ..... 5/706, 710, 712, 5/713, 644, 654, 655.3, 932

(56) References Cited

U.S. PATENT DOCUMENTS

| | | | | |
|---|---|---|---|---|
| 1,733,034 A | * | 10/1929 | Tufenkjian | 5/710 |
| 2,703,770 A | * | 3/1955 | Melzer | 5/710 |
| 3,030,640 A | * | 4/1962 | Gosman | 5/655.3 X |
| 3,568,227 A | * | 3/1971 | Dunham | 5/644 X |
| 4,225,989 A | * | 10/1980 | Corbett et al. | 5/713 |
| 4,389,742 A | * | 6/1983 | DeWitt | 5/654 |
| 4,547,919 A | * | 10/1985 | Wang | 5/706 X |
| 4,724,560 A | * | 2/1988 | Christie | 5/644 |
| 5,044,030 A | * | 9/1991 | Balaton | 5/710 |
| 5,243,722 A | * | 9/1993 | Gusakov | 5/655.3 |
| 5,304,271 A | * | 4/1994 | Gusakov | 5/655.3 X |
| 5,638,565 A | * | 6/1997 | Pekar | 5/710 |
| 5,890,245 A | * | 4/1999 | Klearman et al. | 5/714 |
| 6,402,879 B1 | * | 6/2002 | Tawney et al. | 156/292 |
| 2002/0050010 A1 | * | 5/2002 | Shimada | 5/706 |

FOREIGN PATENT DOCUMENTS

| | | |
|---|---|---|
| GB | 2 197 192 | 5/1988 |
| JP | 7-51325 | 2/1995 |

OTHER PUBLICATIONS

Communication dated Nov. 4, 2002.
European Search Report dated Oct. 28, 2002.

* cited by examiner

*Primary Examiner*—Robert G. Santos
(74) *Attorney, Agent, or Firm*—Armstrong, Westerman & Hattori, LLP

(57) ABSTRACT

An air mattress includes a first through a fourth sheets (6, 7, 8, and 9), respectively, which are bonded together along the peripheries thereof and at a multiplicity of bonding spots, creating a triple-layer air cell structure consisting of a first, a second, and a third air cells (13, 15, and 17), respectively. A multiplicity of first bonding spots (10) bonding the first and second sheets together are spaced apart at regular intervals along longitudinal and transverse lines such that four neighboring spots occupy four corners of a tetragon. On the other hand, a multiplicity of second bonding spots (14) bonding the second and the third sheets together are arranged at positions which correspond to the centers of the tetragons. The third air cell has the same structure as the first air cell. These air cells are inflated such that the third air cell maintains high a pressure, while the first and second air cells maintain a low pressure. The low pressure air mattress may effectively prevent bedsores.

11 Claims, 7 Drawing Sheets

(A-A)

(B-B)

(C-C)

AIR MATTRESS

FIELD OF THE INVENTION

The invention relates to an air mattress capable of remedying, preventing, or relieving bedsores of a patient.

BACKGROUND OF THE INVENTION

Patients in long term treatments, especially bedridden old patients, are liable to suffer from bedsores. A bedsore is caused by necrosis resulting from venous congestion due to a pressure or patient's weight acting on the patient's afferent veins more than the bloodstream blockage pressure.

An air mattress having a lower air pressure in air cells than the bloodstream blockage pressure in afferent veins to prevent bedsores is disclosed in JP-A-7-51325.

This prior art air mattress has a generally rectangular form like a bed, as shown in FIG. 1. The air mattress includes a first bag-shaped body 1 made of a flexible sheet, which in turn included therein a second bag-shaped body 2 made of a flexible sheet and having a smaller surface area than the first bag-shaped body 1. The second bag-shaped body 2 is welded to the inside of the first bag-shaped body 1 at spots A, and at the same time the opposite sides of the second bag-shaped body 2 itself are welded together at multiple weld spots B. The weld spots A at which the second bag-shaped body 2 are welded to the first bag-shaped body 1 are spaced apart in the longitudinal and transverse directions of the bag-shaped bodies at regular intervals, while each of the weld spots B is provided between two longitudinally neighboring weld spots A.

The cross section of the air mattress taken along line X—X passing through weld spots A and B has a complex sinusoidal structure as shown in FIG. 2. The cross section of the air mattress taken along line Y—Y passing between weld spots A and B has a weakly waving sinusoidal structure as shown in FIG. 3. In this air mattress, the first bag-shaped body 1 has an air pressure not exceeding the bloodstream blockage pressure, which is about 32 mmHg in veins. The pressure in the second bag-shaped body 2 is in the range of 0–30 mmHg. In FIG. 1, reference numeral 3 indicates minute holes formed in the weld spot A to allow the air in the second bag-shaped body 2 to escape. Numerals 4*a* and 4*b* refer to air-supply pipes.

The prior art air mattress as mentioned above has the following drawbacks.

(i) Since the weld spots A of the first bag-shaped body 1 and the weld spots B of the second bag-shaped body 2 are aligned along longitudinal lines, each region of the bag-shaped bodies 1 and 2 between two neighboring longitudinal lines forms a slightly waving linear protrusion or crest, as shown in FIG. 3. Such elongate protrusion or crest will have a relatively large tension T in the longitudinal direction when the elongate protrusion is deformed by the weight of a patient 4, as shown in FIG. 4. The tension T reacts on that part of the patient's skin deforming the protrusion and causes a bedsore. Especially, a portion of the patient's body where bones e.g. sacrum protrude receives a larger pressure due to the tension T, which can easily cause a bedsore or worsen it.

(ii) Portions of the first bag-shaped body 1 between weld spots As and Bs have a relatively flat top face as shown in FIG. 5, which face tends to creep in Z-direction, thereby posing the same problem as in (i). In particular, the horizontal surfaces of those portions of the first bag-shaped body 1 that correspond to the weld spots B is presumed to be platter in Z-direction than in other directions.

(iii) At the weld spots A, the air mattress has only a single air cell layer of the second bag-shaped body 2, which has an extremely low inner pressure in the range of 0–30 mmHg. As a result, the mattress may develop a so-called bottoming phenomenon in which the portion of the patient's body lying on the low-pressure section of the mattress sinks to the floor by the weight of the patient, which can be a direct cause of bedsore. The bottoming phenomenon is also a source of uneasiness and uncomfortability for a patient.

SUMMARY OF THE INVENTION

It is therefore an object of the invention to provide a low-pressure air mattress which is capable of preventing, remedying, or relieving bedsores of a patient. The inventive air mattress is also capable of preventing bottoming thereof.

In accordance with one aspect of the invention, there is provided an air mattress, comprising:

a first through a fourth flexible sheets which are stacked in the order mentioned and bonded together along the peripheries thereof so as to be sealed together, wherein the first and second sheets are bonded together at a multiplicity of first bonding spots thereof spaced apart along longitudinal and transverse lines at regular intervals such that four neighboring bonding spots occupy four corners of a tetragon;

the second and the third sheets are bonded together at a multiplicity of second bonding spots thereof at locations which correspond to the centers of the tetragons; and the third and the fourth sheets are bonded together at a multiplicity of third bonding spots thereof at positions which correspond to the multiplicity of first bonding spots, and wherein the first and second sheets together define first air cell, the second and third sheets together define second air cell, and the third and fourth sheets together define third air cell.

In this air mattress, tetragonal regions each defined by four neighboring first bonding spots form first protrusions of the first air cell when inflated with air. These first protrusions extend contiguously in the longitudinal and transverse directions. The third air cell has the same structure as the first one when it is inflated. In the second air cell, tetragonal regions each defined by four neighboring second bonding spots form second protrusions extending contiguously in the longitudinal and transverse directions. The apexes of the second protrusions correspond to the first bonding spots.

The tetragons may be squares or rectangles. In this arrangement, both the first and second protrusions each have a semispherical or an oblong semispherical shape, which extend in the two perpendicular directions at regular intervals, thereby creating by the first protrusions substantially isotropic supportive forces to a patient.

It is noted that the first air cell is provided above the second and the third air cells, and that the first and second air cells maintain a sufficiently low air pressure which is less likely to cause bedsores, while the third air cell maintain a high air pressure which is less likely to allow bottoming. In this arrangement, the air mattress may support broad areas of the patient by the multiplicity of supportive soft protrusions of the first and second air cells while preventing bottoming of the air mattress by the third air cell.

The first and the second air cells may be alternately inflated and deflated by air while keeping the third air cell inflated at a predetermined air pressure. In this instance, the air mattress periodically changes supporting areas for the patient to avoid bearing or stressing him at the same physical portions for a long time.

In accordance with the invention, a low-pressure air mattress is provided which have a triple vertical layers of air cells, with the first and second air cells forming two upper layers to maintain a low air pressure to thereby prevent bedsores of a patient and the third air cell forming the lowest layer to maintain a high air pressure to thereby preventing bottoming. It is noted that the high-pressure third air cell serves to prevent bottoming of the air mattress, and that the first and second air cells have a sufficiently low air pressure to prevent bedsores.

In accordance with the invention, each of the first protrusions formed on the surface of the first air cell has a generally semi-spherical shape. Thus, it can be laterally offset only a little when in touch with the skin of the patient and the lateral pull of the skin by the offset is substantially the same in any lateral direction. The invention may prevents a fairly large lateral pull of the skin by an elongate protrusion as encountered in prior art air cells. Thus, the air mattress of the invention may suppress tensions in the air cell that could otherwise act on weaken skins of the patient and cause bedsores.

DETAILED DESCRIPTION OF THE PREFERRED EMBODIMENTS

Figure 1:
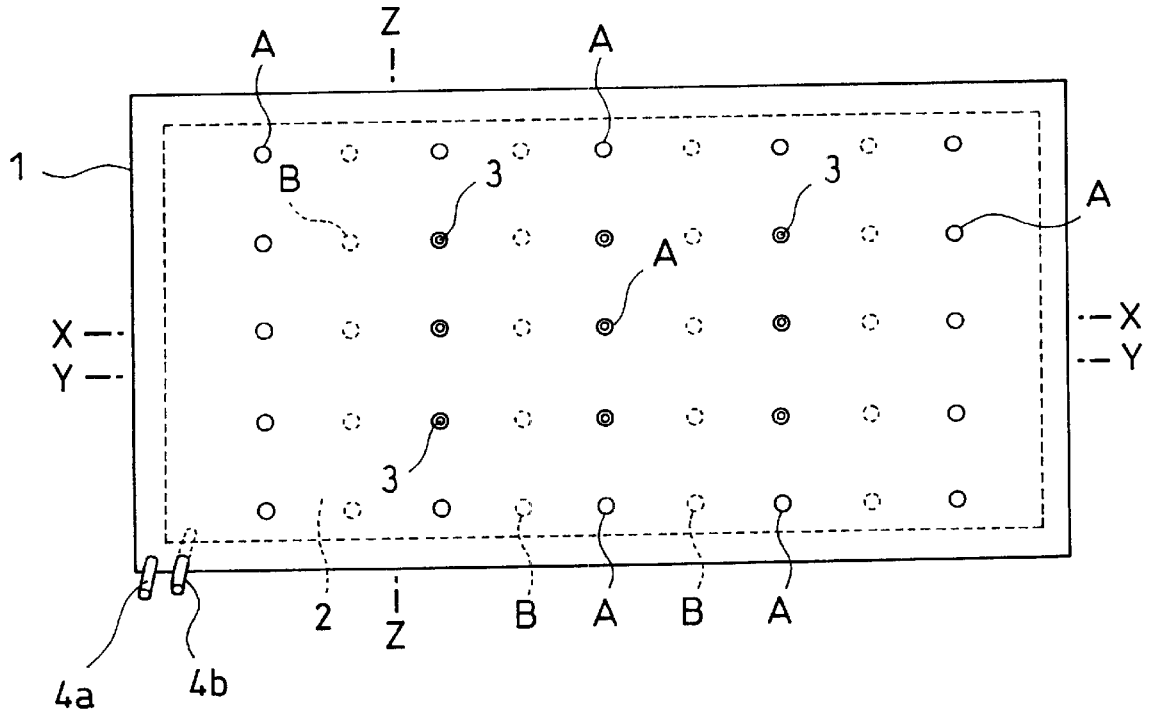
FIG. 1 is a plan view of a conventional air mattress.
Figure 2:
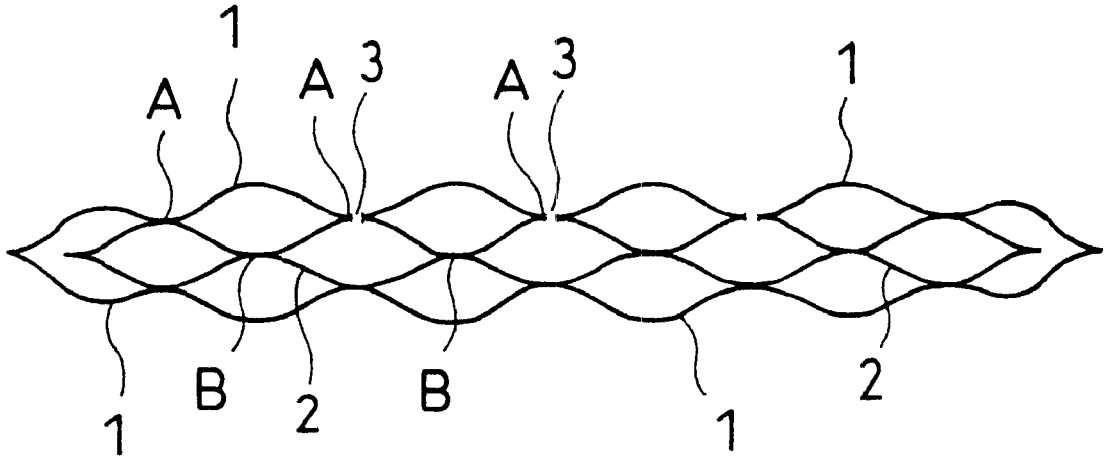
FIG. 2 is a cross sectional view taken along line X—X of FIG. 1.
Figure 3:
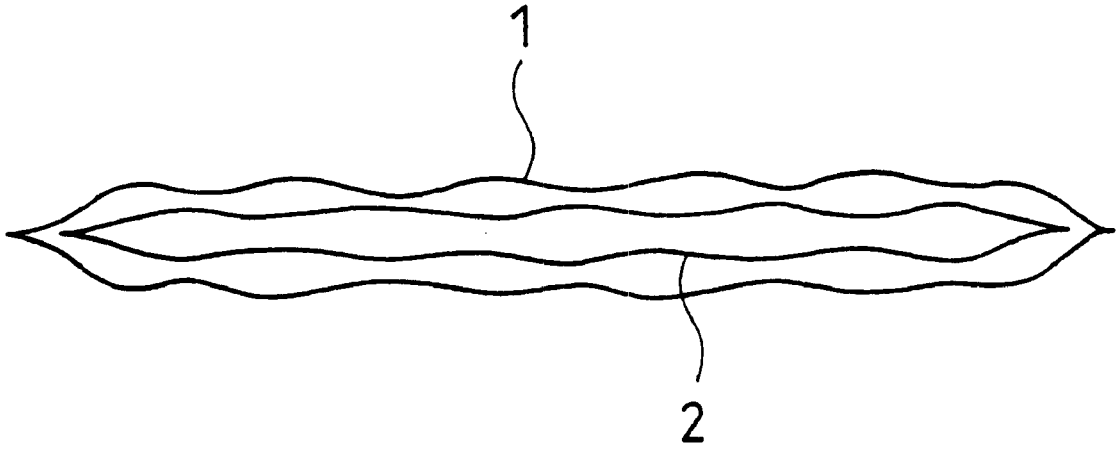
FIG. 3 is a cross sectional view taken along line Y—Y of FIG. 1.
Figure 4:
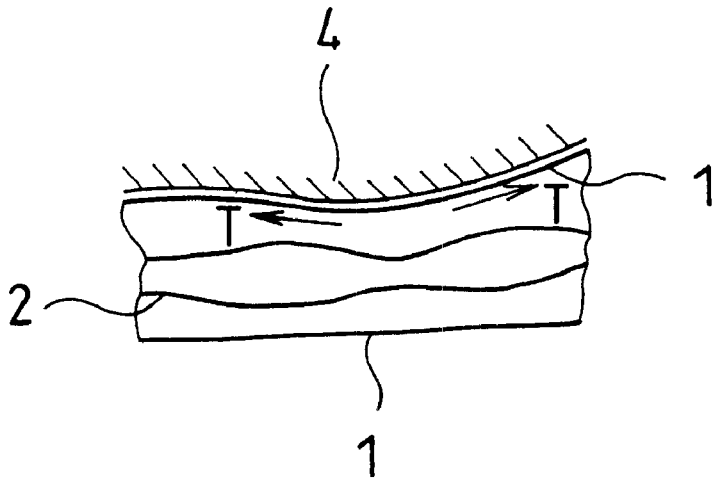
FIG. 4 is a cross sectional view of an air mattress, illustrating a condition of an air mattress under a shear stress.
Figure 5:
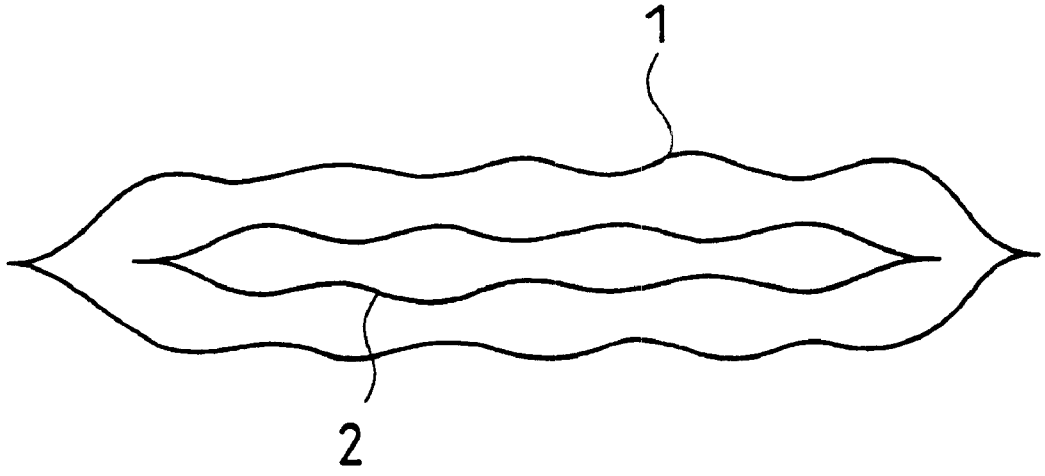
FIG. 5 is a cross sectional view of the air mattress taken along line Z—Z of FIG. 1.
Figure 6:
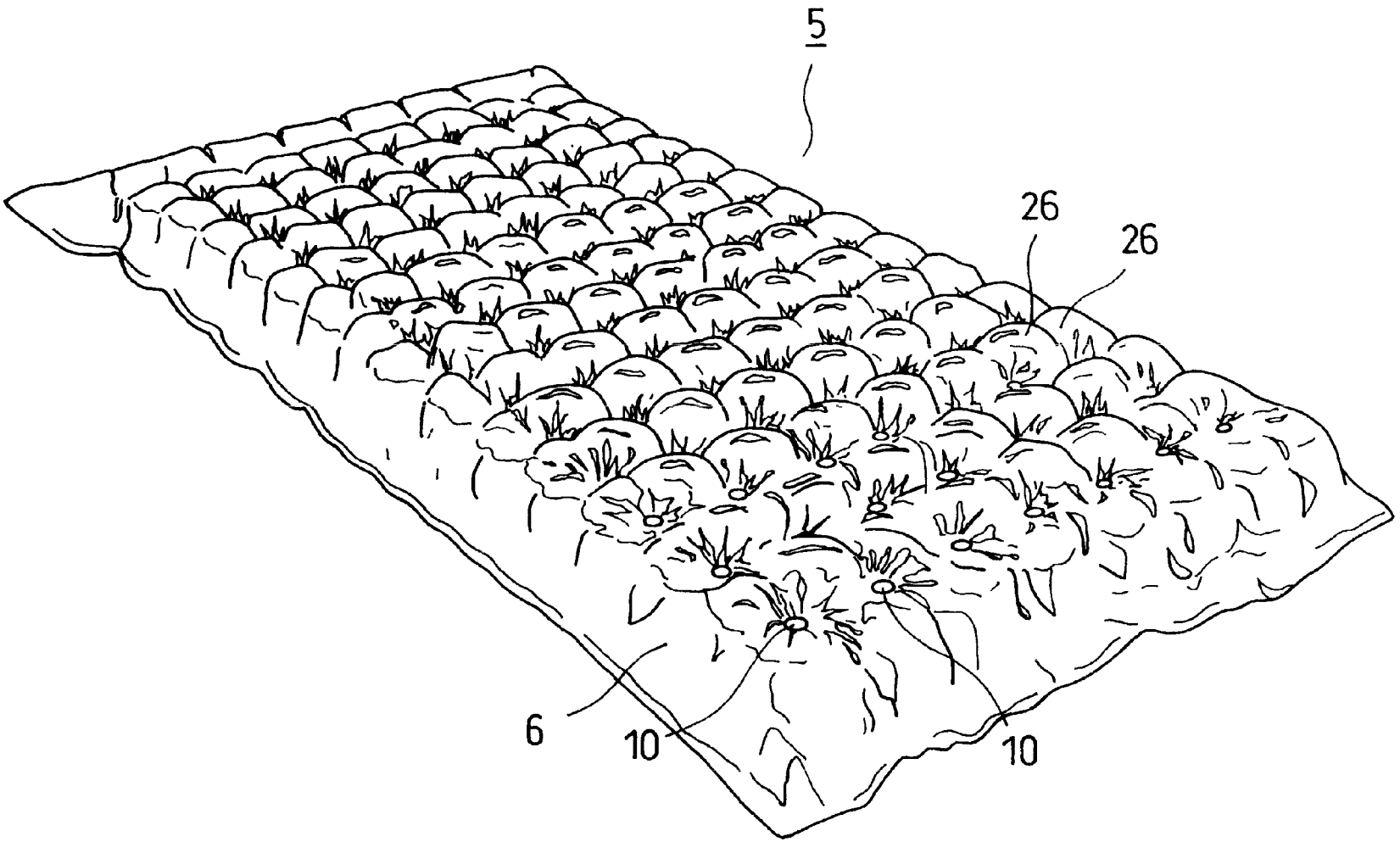
FIG. 6 is a perspective view of an air mattress embodying the invention.
Figure 7:
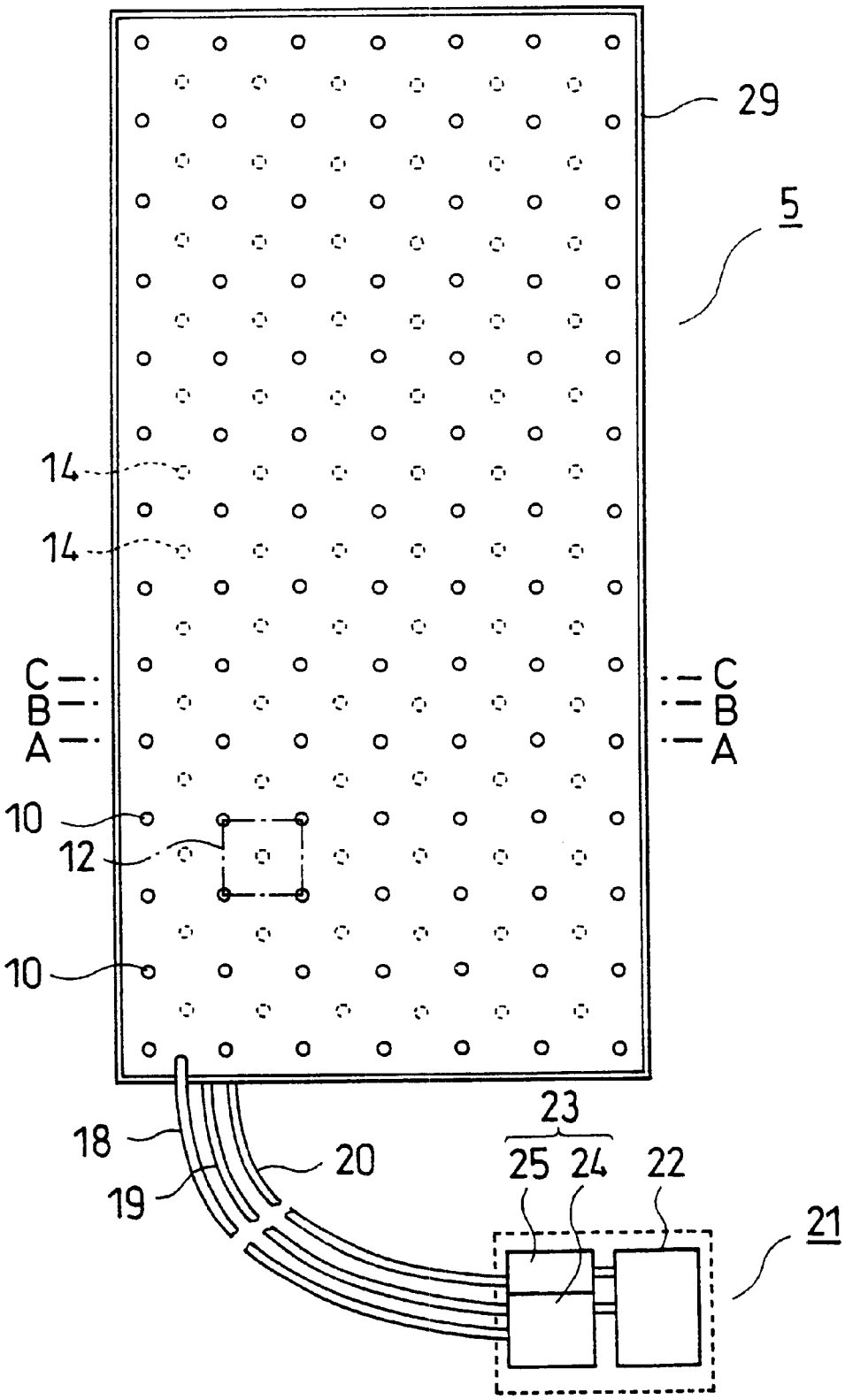
FIG. 7 is a plan view of the air mattress of FIG. 6.
Figure 8:
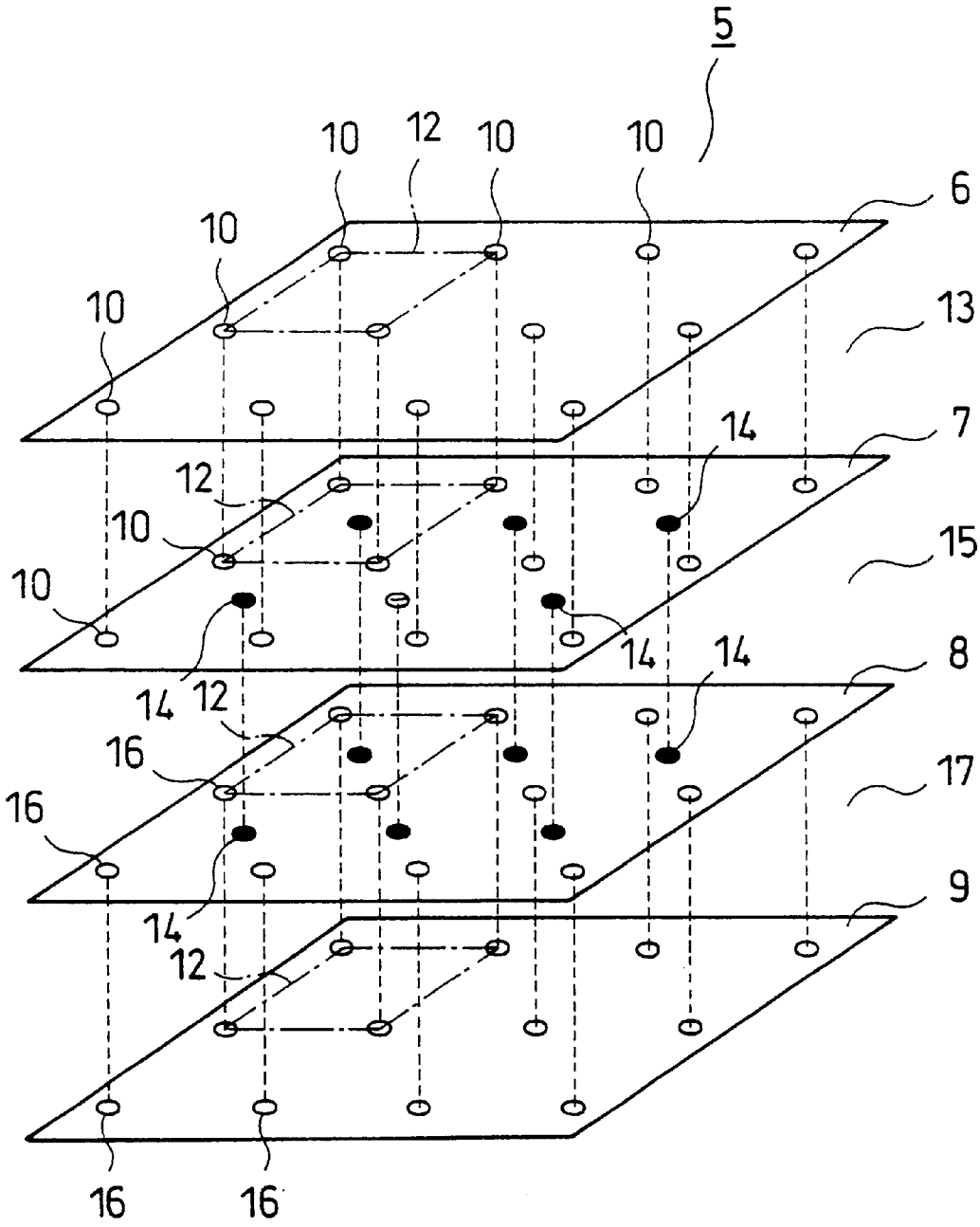
FIG. 8 is a perspective view of the air mattress of FIG. 7, showing bonding of the first through the fourth sheets.

Referring now to FIGS. 6 through 8, there is shown an air mattress 5 of the invention. It is seen that four flexible rectangular sheets 6, 7, 8, and 9 are stacked together in the order mentioned and bonded together at their peripheries to form inside thereof three layers of sealed spaces. Each of the three spaces are provided with an inlet/outlet air tube.

The first and second sheets 6 and 7, respectively, are bonded together at a multiplicity of first bonding spots 10. These multiple first bonding spots 10 are arranged at regular intervals along longitudinal and transverse lines. The first bonding spots 10 are arranged such that four neighboring bonding spots occupy four corners of a tetragon 12 shown by a dashed line. Preferably, each of the tetragons 12 is a square. However, the tetragon may be a rectangle as well. The first and second sheets 6 and 7, respectively, form a first air cell 13.

The second and the third sheets 7 and 8, respectively, are bonded at a multiplicity of second bonding spots 14. The second bonding spots 14 are also arranged at regular intervals along longitudinal and transverse lines. The second bonding spots 14 are positioned such that they occupy centers of the tetragons 12 of the first bonding spots 10 in the adjacent layer. Thus, when the tetragons 12 are squares, the tetragons defined by four neighboring second bonding spots 14 are also squares. Similarly, when the tetragons 12 are rectangles, so are the tetragons defined by four second bonding spots 14. Formed between the second and the third sheets 7 and 8, respectively, is a second air cell 15.

The third and the fourth sheets 8 and 9, respectively, are bonded together at a multiplicity of the third bonding spots 16. The third bonding spots 16 are located at the same positions, and have the same structure, as the first bonding spots 10. Formed between the third and the fourth sheets 8 and 9, respectively, is a third air cell 17.

The first, second, and third air cells 13, 15, and 17, respectively, are provided with air inlet/outlet tubes 18, 19, and 20, respectively.

It is noted that the sizes and the shapes of the first, second, and third bonding spots 10, 14, and 16, respectively, are in actuality determined based on bonding requirement, e.g. bonding strength of the sheets used. For example, the bonding spots may be circular in shape and have a diameter in the range of about 2 to 4 cm. They can be elliptic or polygonal as well.

An air pump unit 21 shown in FIG. 7 has an air pump 22 and a controller 23. The controller 23 includes a first controller 24 for controlling the air pressure in the first and second air cells 13 and 15, respectively, and a second controller 25 for controlling the air pressure in the third air cell 17.

The first controller 24 is adapted to control air supply from the air pump 22 to the first and second air cells 13 and 15, respectively, and exhausting of the air, such that the air pressure in the air cells 13 and 15 are maintain at a given level and that the first and second air cells 13 and 15, respectively, are alternately inflated/deflated. The second controller 25 serves to maintain the pressure in the third air cell 17 at a predetermined level. The first and second controllers 24 and 25, respectively, have built-in pressure sensors (not shown) for detecting the pressures in the first through the third air cells 13, 15, and 17, respectively.

The first through the fourth sheets 6, 7, 8, and 9, respectively, may be formed of an air-impermeable polyurethane plastic resin film. The first through the third bonding spots 10, 14, and 16, respectively, may be welded by a high-frequency welding technique. In welding the first bonding spots 10, the first sheet 6 and the second sheet 7 are aligned and superposed together. Similarly, the second bonding spots 14 are welded while keeping the second sheet 7 and the third sheet 8 stacked together; the third bonding spots 16 are welded while keeping the third sheet 8 and the fourth sheet 9 stacked together. The peripheries of the first through the fourth sheets 6, 7, 8, and 9, respectively, are also welded together while keeping these peripheries stacked together to form a welded section 29.

As a specific example, longitudinal and transverse spacings between two neighboring first bonding spots 10 are 12 cm, and so is the spacing of the third bonding spots 16. Hence, the second bonding spots 14 has the same spacing. The bonding of these sheets may be attained in a different way, using a bond for example.

The first air cell 13 and the third air cell 17 have the same configuration with the second air cell 15 interposed between the first and the third air cells 13 and 17, respectively. The cross sections taken along lines A—A, B—B, and C—C of FIG. 7 of the air cells are shown in FIGS. 9–11.

Figure 9:
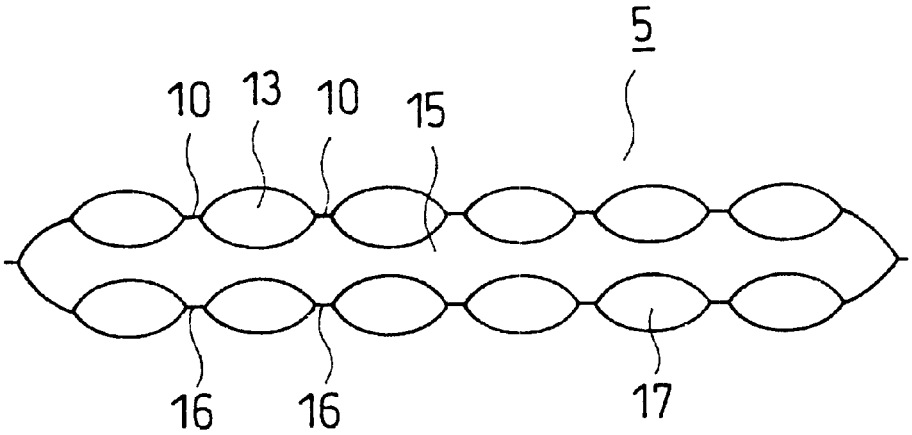
FIG. 9 is a cross section of the air mattress taken along line A—A of FIG. 7.
Figure 10:
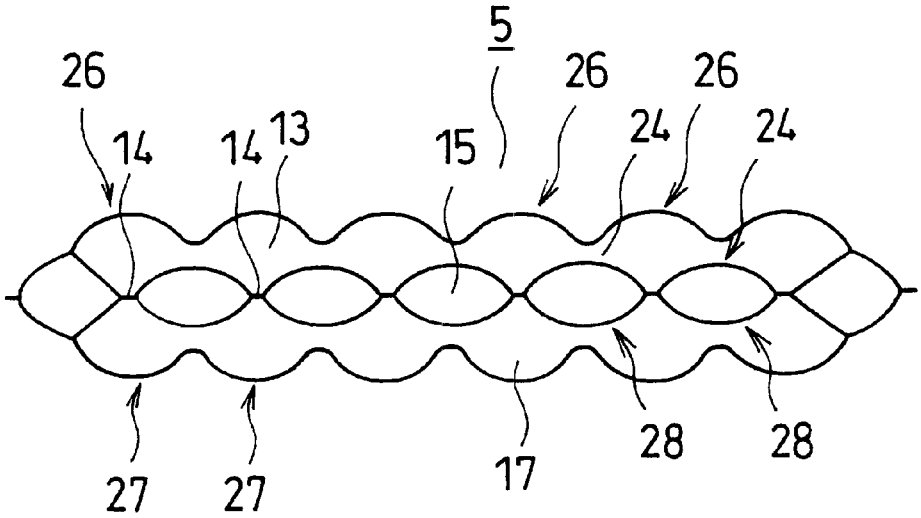
FIG. 10 is a cross section of the air mattress taken along line B—B of FIG. 7.
Figure 11:
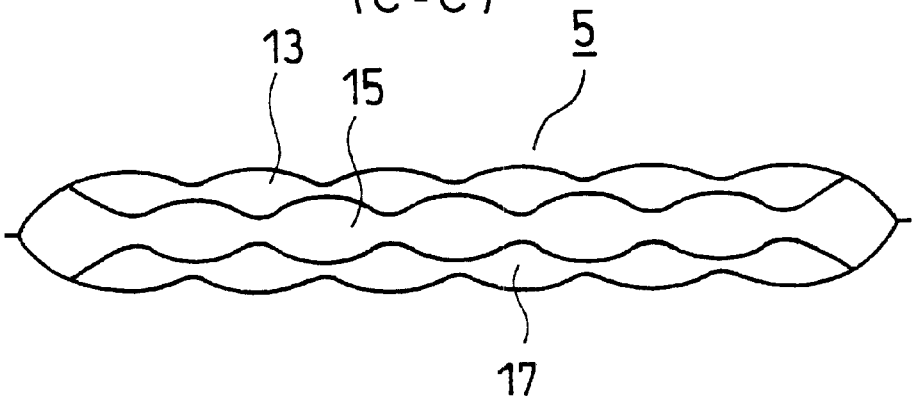
FIG. 11 is a cross section of the air mattress taken along line C—C of FIG. 7.

As shown in FIGS. 9–11, the first, the second, and the third air cells 13, 15, and 17, respectively, are vertically stacked in the order mentioned. When inflated with air, the tetragonal regions 12 defined by respective four adjacent first bonding spots 10 expand to form a 2-dimensional array of first protruding sections 26 extending at regular interval of 12 cm in longitudinal and transverse directions. Below the first protruding sections 26 are similar third protruding sections 27 of the third air cell. Upon charging air into the air mattress, tetragonal regions 12 defined by respective four adjacent second bonding spots 14 of the second air cell 15 also expand to form a similar array of second protruding sections 28 having their peaks at positions which correspond to the first bonding spots 10 and the third bonding spots 16.

In use of this air mattress 5, the first and second air cells 13 and 15, respectively, may have a pressure as low as 40 mmHg for example, while the third air cell 17 has a high pressure of about 80 mmHg. The air pressures are controlled by first and second controllers 24 and 25, respectively. The pressures of air in the respective air cells may be arbitrarily adjusted by the first and second controllers 24 and 25, respectively.

Thus, by setting the pressures in the first and second air cells 13, 15 to a low pressure, and in the third air cell 17 to a high pressure, patient's weight is evenly distributed to the first and second air cells 13, 15 so that the patient is supported by the air cells 13 and 15 in a proper condition to prevent his or her bedsores. Since the well inflated third air cell 17 exists under the weakly inflated air cells 13 and 15, the patient will be securely supported by the third air cell 17 even when the first and second air cells 13 and 15, respectively, are squashed by the patient's weight, which helps prevent bottoming. In this usage, the thickness of the air mattress is about 15 cm.

In another usage of the air mattress, the first and second air cells 13 and 15 are alternately and periodically inflated and deflated while keeping the third air cell 17 at a high pressure so that the air mattress periodically supports different body positions of the patient. In this instance, the first and second air cells 13 and 15, respectively, are alternately supplied with air of about 40 mmHg when inflated by the first controller 24 and air of about 20 mmHg when deflated at a period which ranges from a few minutes to about ten several minutes. Deflation of the air cells to a level of about 20 mmHg, leaving some air therein, will eliminate rough bumps of the first and second air cells 13, 15, thereby alleviating patient's discomfort. The air cells may be completely deflated to 0 mmHg. However, the pressure is normally kept in the range between 0 and 30 mmHg, depending on the conditions of the patient. On the other hand, the third air cell 17 is maintained by the second controller 25 at about 80 mmHg (which prevents bottoming of the air mattress).

Thus, by periodically varying the air pressure in the first and second air cells 13, 15, it is possible to avoid continuously supporting the same body portions of a patient, thereby effectively preventing blood stream blockage.

In a further usage of the air mattress 5, only the first air cell 13 may be inflated, with the second and the third air cells 15 and 17, respectively, being deflated. This usage is suited for a patient who can change his position on the mattress 5 for himself. In this instance the air pressure may be set in the range of about 60–70 mmHg. Since in this case only the first air cell 13 is inflated, the thickness of the mattress 5 is in the range of about 7–8 cm, which is adequate thickness for a patient to change his position on the mattress 5 for himself.

I claim:

1. An air mattress, comprising:

a first through a fourth flexible sheets which are stacked in the order mentioned and bonded together along the peripheries thereof so as to be sealed, wherein said first and second sheets are bonded together at a multiplicity of first bonding spots thereof spaced apart along longitudinal and transverse lines at regular intervals such that four neighboring bonding spots occupy four corners of a tetragon;

said second and said third sheets are bonded together at a multiplicity of second bonding spots thereof at locations which correspond to the centers of said tetragons; and said third and said fourth sheets are bonded together at a multiplicity of third bonding spots thereof at positions which correspond to said multiplicity of first bonding spots; wherein said first and second sheets define a first air cell, said second and third sheets define a second air cell, and said third and fourth sheets define a third air cell;

a first inlet/outlet tube communicating only with the first air cell; and a second inlet/outlet tube communicating only with the second air cell.

2. The air mattress according to claim 1, wherein said tetragon is a square.

3. The air mattress according to claim 2, wherein said first air cell is above said second and third air cells; and said first and second air cells are inflated to a low air pressure which is less likely to cause a bedsore, while said third air cell is inflated to a higher air pressure which is not likely to cause bottoming of said third air cell.

4. The air mattress according to claim 3, wherein said first air cell and second air cell are alternately inflated and deflated, while said third air cell is maintained at a predetermined pressure.

5. The air mattress according to claim 1, wherein said tetragon is a rectangle.

6. The air mattress according to claim 5, wherein said first air cell is above said second and third air cells; and said first and second air cells are inflated to a low air pressure which is less likely to cause a bedsore, while said third air cell is inflated to a higher air pressure which is not likely to cause bottoming of said third air cell.

7. The air mattress according to claim 6, wherein said first air cell and second air cell are alternately inflated and deflated, while said third air cell is maintained at a predetermined pressure.

8. The air mattress according to claim 1, wherein said first air cells are above said second and third air cell; and said first and second air cells are inflated to a low air pressure which is less likely to cause a bedsore, while said third air cell is inflated to a higher air pressure which is not likely to cause bottoming of said third air cell.

9. The air mattress according to claim 8, wherein said first air cell and second air cell are alternately inflated and deflated, while said third air cell is maintained at a predetermined pressure.

10. The air mattress according to claim 1, comprising a third inlet/outlet tube communicating only with the third air cell.

11. The air mattress according to claim 1, wherein said air mattress comprises no additional flexible sheets, whereby the air mattress comprises exactly four flexible sheets.

* * * * *